US007963692B2

(12) United States Patent
Lynn

(10) Patent No.: US 7,963,692 B2
(45) Date of Patent: Jun. 21, 2011

(54) MONITORING APPARATUS

(75) Inventor: John Morris Lynn, Austin, TX (US)

(73) Assignee: Flotime, LLC, Round Rock, TX (US)

( * ) Notice: Subject to any disclaimer, the term of this patent is extended or adjusted under 35 U.S.C. 154(b) by 197 days.

(21) Appl. No.: 12/380,331

(22) Filed: Feb. 26, 2009

(65) Prior Publication Data

US 2009/0211642 A1 Aug. 27, 2009

Related U.S. Application Data

(60) Provisional application No. 61/067,263, filed on Feb. 27, 2008, provisional application No. 61/129,676, filed on Jul. 11, 2008, provisional application No. 61/125,809, filed on Apr. 29, 2008.

(51) Int. Cl.
*G04F 1/00* (2006.01)

(52) U.S. Cl. ..... 368/89; 368/327

(58) Field of Classification Search ..... 368/93, 368/327, 89, 278, 10

See application file for complete search history.

(56) References Cited

U.S. PATENT DOCUMENTS

| | | | | |
|---|---|---|---|---|
| 1,807,752 | A | 6/1931 | Poster | |
| 1,923,978 | A * | 8/1933 | Hill | 368/10 |
| 2,122,351 | A * | 6/1938 | Morris | 368/91 |
| 2,552,477 | A * | 5/1951 | Cole | 374/102 |
| 3,420,205 | A | 1/1969 | Morison | |
| 3,786,777 | A | 1/1974 | Smith et al. | |
| 3,933,337 | A | 1/1976 | Morris et al. | |
| 3,954,011 | A | 5/1976 | Manske | |
| 4,002,139 | A | 1/1977 | Payne | |
| 4,028,876 | A * | 6/1977 | Delatorre | 368/89 |
| 4,028,877 | A | 6/1977 | Vatterott | |
| 4,148,272 | A * | 4/1979 | Wetzold | 116/219 |
| 4,154,107 | A | 5/1979 | Giezen et al. | |
| 4,206,838 | A | 6/1980 | Bradley | |
| 4,229,813 | A | 10/1980 | Lilly et al. | |
| 4,304,342 | A * | 12/1981 | Morane | 222/402.23 |
| 4,447,161 | A | 5/1984 | Stoll et al. | |
| 4,550,676 | A * | 11/1985 | Francis | 116/206 |
| 4,629,330 | A | 12/1986 | Nichols | |
| D307,870 | S | 5/1990 | Irgang et al. | |
| 5,189,979 | A | 3/1993 | Popenoe | |
| 5,343,444 | A | 8/1994 | Agut | |
| 5,457,665 | A | 10/1995 | Reid | |
| 5,602,804 | A | 2/1997 | Haas | |
| 5,667,303 | A | 9/1997 | Arens et al. | |
| 5,822,280 | A | 10/1998 | Haas | |
| 5,930,206 | A | 7/1999 | Haas et al. | |
| 5,958,525 | A | 9/1999 | Green et al. | |
| 6,236,624 | B1 | 5/2001 | Kriesel et al. | |
| 6,314,907 | B1 * | 11/2001 | Harris et al. | 116/206 |
| 6,373,786 | B1 * | 4/2002 | Kagan et al. | 368/10 |
| 6,682,521 | B2 * | 1/2004 | Petrakis | 604/890.1 |
| 6,741,523 | B1 | 5/2004 | Bommarito et al. | |
| 6,832,916 | B2 * | 12/2004 | Collopy | 434/236 |
| 6,916,116 | B2 * | 7/2005 | Diekmann et al. | 374/102 |
| 7,018,847 | B2 | 3/2006 | Unger et al. | |

(Continued)

*Primary Examiner* — Sean Kayes

(57) ABSTRACT

A monitoring apparatus is disclosed for monitoring time by a color change indicator, comprising an observable fluid, a first reservoir holding at least a portion of the observable fluid, and a second reservoir abutting the first reservoir. The first reservoir is responsive to pressure on it such that a portion of the observable fluid flows into the second reservoir. The second reservoir is responsive to a lack of pressure in the first reservoir such that a portion of the observable fluid in the second reservoir reverses flow back into the first reservoir once the first reservoir is not under pressure.

16 Claims, 4 Drawing Sheets

U.S. PATENT DOCUMENTS

| | | | | |
|---|---|---|---|---|
| 7,280,441 | B2 | 10/2007 | MacDonald et al. | |
| 7,362,660 | B2 * | 4/2008 | Hildebrandt | 368/10 |
| 7,388,814 | B2 | 6/2008 | Teffenhart et al. | |
| 7,593,290 | B2 * | 9/2009 | Stange et al. | 368/10 |
| 7,643,378 | B2 * | 1/2010 | Genosar | 368/10 |
| 7,663,977 | B1 * | 2/2010 | Hartelius | 368/10 |
| 2004/0013048 | A1 | 1/2004 | Adamy | |
| 2007/0195652 | A1 | 8/2007 | Ambrozy et al. | |

* cited by examiner

MONITORING APPARATUS

CROSS-REFERENCE TO RELATED APPLICATION

This application claims priority to Provisional Patent Application No. 61/067,263 filed Feb. 27, 2008, entitled "Method and Apparatus for Determining the Prior Usage of a Medical Container"; Provisional Patent Application No. 61/129,676 filed Jul. 11, 2008, entitled "Timing Apparatus"; and Provisional Patent Application No. 61/125,809 filed Apr. 29, 2008, entitled "Timing Apparatus"; the disclosures of which are each expressly incorporated herein by reference.

TECHNICAL FIELD

This invention relates to determining a recent usage history for various items, such as medical containers, via an indicator. In particular, the indicator can change its appearance over a period of time.

BACKGROUND

Certain monitoring apparatuses are known in the art. One current art method is to have a multiple compartment pill container for daily pills taken on a regular basis. The pill container lists each day of the week on seven compartments, for example, and at the start of each week a user fills the container with the pills for week. This method works well for users having a daily routine with pills meant to be taken once a day. But it is not always helpful for pills intended to be taken more than once a day. The multiple compartment pill container also does not work well for users who do not have a daily routine or for users who are taking pills for a particular illness for a short period of time. Such intermittent users of medicine are not likely to have a weekly container. Even if the intermittent users do have such a weekly container, they are not in the habit of using the container and the container may go unused.

Accordingly, in addition to the standard weekly pharmaceutical container method, other known reminder and timing methods and devices exist. These prior art devices and methods typically rely on complicated mechanical devices or electronic devices. These complicated devices are normally designed to let a user know when the pill bottle was opened last. Since most pill bottles are small, these complicated prior art devices are unwieldy, weigh too much, are too expensive, and can be difficult to use.

The monitoring apparatus described herein can be used in a large number of different contexts and associated with many different apparatuses. One important example of a potential use of the monitoring apparatus described herein concerns the importance of taking medication or vitamins when they are supposed to be taken. Some studies show that 10% of hospital visits are caused by patients not taking their medications as instructed.

This failure to take medication as instructed often occurs because the user simply can't remember whether or not they have taken their medicine. This forgetfulness can result in either (1) a failure to take a pill on time because the person believes they have already done so, or (2) taking an additional pill (i.e. over medication) because they have forgotten that they have previously taken one. Either scenario can be dangerous or at very least not optimum from a dosage standpoint.

Other uses of the monitoring apparatus described herein include any context in which a user would like to know if they or someone else has recently performed some task (e.g. opening a container). The monitoring apparatus described herein is especially desirable when the person doesn't need to know exactly when they last performed some act (i.e. electronic exactness in time keeping is not necessary). Examples include a timer on sun tan lotion to alert a user to reapply after an amount of time has passed, a timer on a liquid soap bottle, a timer on a toothbrush, household cleaners with a time component related to their use, parents monitoring their children's use of items such as a TV remote, determining when a container of milk was last opened (e.g. how long has it been out of the refrigerator), monitoring whether a user's pet has been fed via a timer on the pet's food bowl, and so forth.

What is needed is a simple, small, and cost effective apparatus and method to inform a user of a medical container or some other apparatus or container when the user last opened or used the apparatus or container or performed some act.

SUMMARY OF THE INVENTION

The techniques described herein provide a monitoring apparatus is disclosed for monitoring time by a color change indicator, comprising an observable fluid, a first reservoir holding at least a portion of the observable fluid, and a second reservoir abutting the first reservoir. The first reservoir is responsive to pressure on it such that a portion of the observable fluid flows into the second reservoir. The second reservoir is responsive to a lack of pressure in the first reservoir such that a portion of the observable fluid in the second reservoir reverses flow back into the first reservoir once the first reservoir is not under pressure.

In one embodiment, a method of monitoring time by a color change indicator comprises containing observable fluid in a first reservoir abutting a second reservoir, applying pressure to the fluid in the first reservoir, forcing at least a portion of the observable fluid from the first reservoir into the second reservoir, and observing the change in appearance of the indicator as the observable fluid reverses flow back into the first reservoir over a predetermined range of time. As described below, other features and variations can be implemented, if desired, and a related method can be utilized, as well.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION

Figure 3:
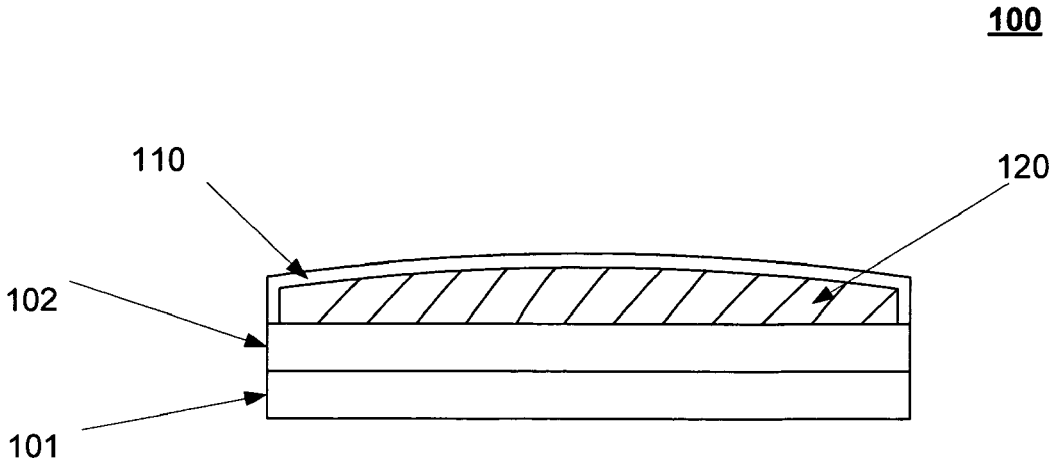
FIG. 3 is a side view of a monitoring apparatus having a flexible membrane and an observable fluid.
Figure 4:
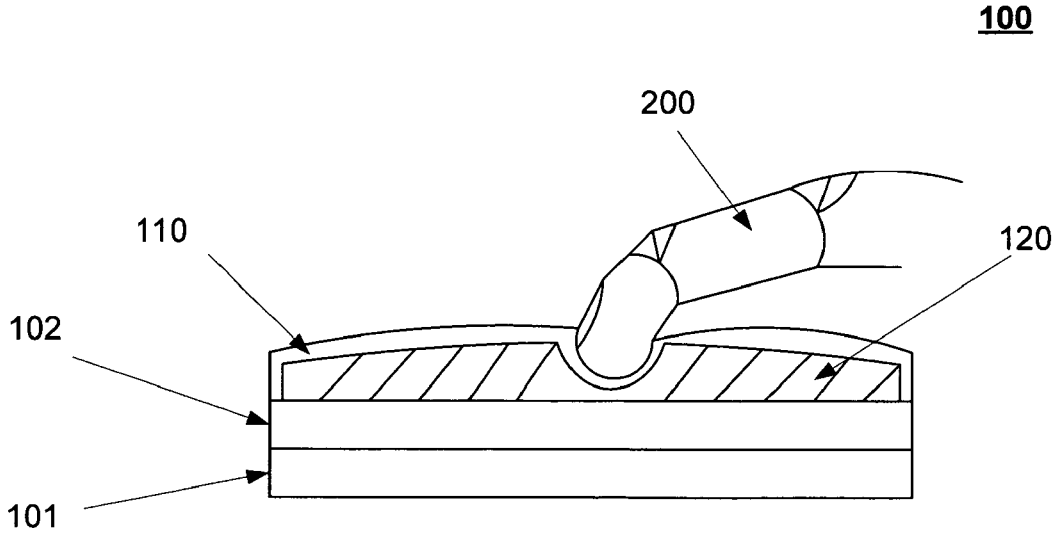
FIG. 4 is a side view of the monitoring apparatus of FIG. 3 having pressure applied to force the fluid from a first reservoir into a second reservoir.
Figure 5:
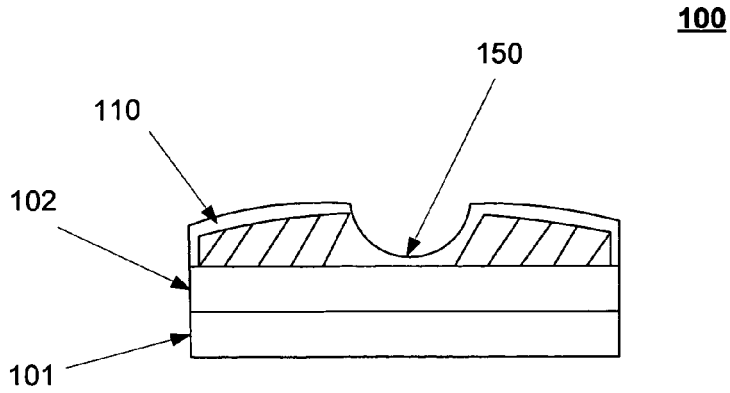
FIG. 5 is a side view of the monitoring apparatus after the fluid has been forced from the first reservoir (i.e., the portion of the indicator under the membrane where the pressure was applied) and before the fluid has returned to the first reservoir and the membrane has returned to its original shape.

The techniques described herein provide a monitoring apparatus for monitoring time by a color change indicator, comprising an observable fluid, a first reservoir holding at least a portion of the observable fluid, and a second reservoir abutting the first reservoir. The first reservoir is responsive to pressure on it such that a portion of the observable fluid flows into the second reservoir. The second reservoir is responsive to a lack of pressure in the first reservoir such that a portion of the observable fluid in the second reservoir reverses flow back into the first reservoir once the first reservoir is not under pressure. In some embodiments, even under normal conditions, the second reservoir can also contain the observable fluid, for example, as shown in FIGS. 3-5 described below.

Figure 1:
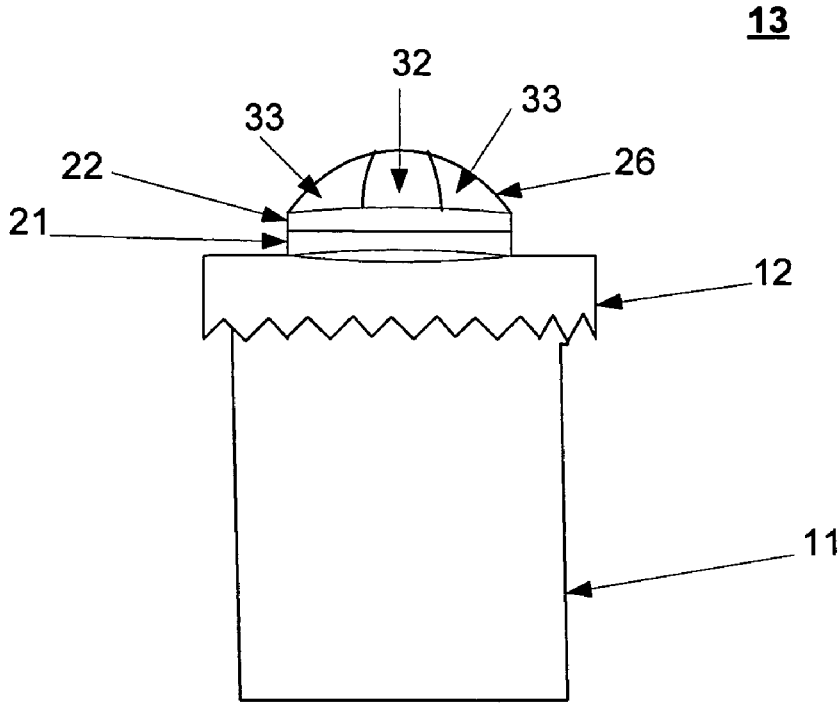
FIG. 1 is a cross section view of a monitoring apparatus having a color change indicator positioned on a cap of a pharmaceutical container.

FIG. 1 shows a standard pharmaceutical container 11 with standard removable cap 12. In FIG. 1, monitoring apparatus 13 is shown on top of cap 12, but it may be placed elsewhere on either pharmaceutical container 11 or cap 12. The key is that it is easy and convenient for a user of pharmaceutical container 11 to activate monitoring apparatus 13. It should also preferably be placed prominently in such a way that it is difficult to forget to activate it. It may also be desirous to place it so that it is impossible to open pharmaceutical container 11 without activating monitoring apparatus 13. This may involve placing it on the side of cap 12 in an area where it is necessary to put pressure on cap 12 in order to bypass the child protective locks on the medical container. This would assure that monitoring apparatus 13 is activated each time pharmaceutical container 11 is opened. If it is desirous to keep monitoring apparatus 13 on top of cap 12 in order to keep it horizontal to the ground and to make it more prominent, then cap 12 may be designed such that the child protective apparatus is activated from the top surface of cap 12.

Monitoring apparatus 13 comprises attachment means 21 to attach monitoring apparatus 13 to the top of cap 12. Attachment means 21 can be any of a number of well known attachment means (e.g. glue, tape, male or female fittings, Velcro and so forth). Attachment means 21 is not always necessary because monitoring apparatus 13 can be made as an integral part of cap 12. However, when monitoring apparatus 13 is sold separately from pharmaceutical container 11 and cap 12 then attachment means 21 is necessary. In some cases it may be desirable for attachment means 21 to also be detachable (e.g. removable tape, removable glue or Velcro) so that it can be used on multiple medical containers, one after another. In other words it may be desirable for monitoring apparatus 13 to outlast the usage on any particular medical container and be usable on other later medical containers.

Figure 2:
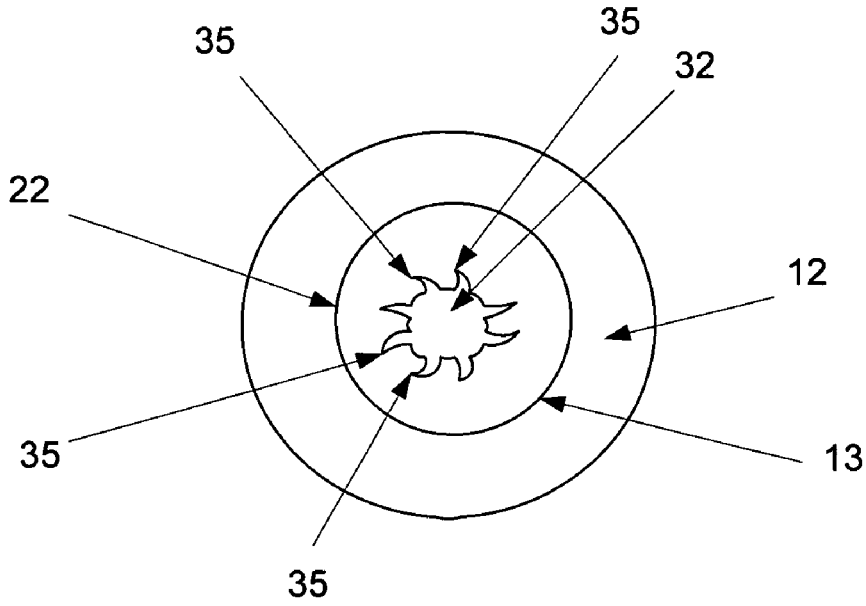
FIG. 2 is a top view of the monitoring apparatus.

In the embodiment shown in FIGS. 1-2, the monitoring apparatus comprises a base 22, a cover 26, and foam 32. The cover 26 is compressible so that foam 32 is also compressible. Under normal circumstances (i.e., when foam 32 has not been pressured), foam 32 contains an observable fluid (not expressly shown). However, when cover 26 is pressed and foam 32 (i.e., the first reservoir) comes under pressure, the observable fluid flows out of foam 32 (i.e., the first reservoir) and into the second reservoir 33 (i.e., the open space defined by cover 26, base 22, but not including foam 32). Once the pressure is relieved from foam 32 (i.e., first reservoir), it will tend to reabsorb (i.e., reverse flow) the observable fluid from second reservoir 33. By observing the change in appearance of the first reservoir and/or the second reservoir as the reverse flow occurs and by knowing the amount of time it takes for the reverse flow to occur, one can determine if foam 32 has been pressed recently. In other words, if there is observable fluid in second reservoir 33, then one knows that foam 32 was recently pressed. In one embodiment, it is important that the base 22 be non-porous so that the observable fluid (e.g., ink or dye) present inside of foam 32 will pool on top of first reservoir 22 and not be absorbed into it. This non-porous material of first reservoir 22 may be any of a number of well known materials. Base 22 is preferably smooth and non-absorbent to the ink or dye. It should also be preferably a color that is easily differentiated (i.e. contrasts) from the observable fluid. Possible materials include silicon, Mylar, PVC and any of a number of non-porous plastics or metals.

Cover 26 is designed to assure that the ink or dye in foam 32 does not either (1) escape from the indicator when it is pressed out of foam 32, or (2) get on the hands of the user of the indicator when it is activated. In order to allow foam 32 to be compressed, cover 26 must be flexible enough to allow the user to compress foam 32 by pressing down on cover 26. Finally, cover 26 also needs to be transparent so a user can see the color changes that will occur to foam 32 and base 22 when foam 32 is compressed. Cover 26 may be any of a number of well known membranes or plastic covers well known in the art similar to those used for blister packs (e.g. pre-formed plastic such as PVC).

Cover 26, base 22 and foam 32 form the boundaries of a three dimensional space which is available to accept fluids into additional reservoirs. As shown in FIGS. 1 and 2, a second reservoir 33 is present. It is understood that there might be multiple spaces or reservoirs, depending on the shape of foam 32 and cover 26. Second reservoir 33 is important because it is the area where the ink or dye from foam 32 goes when a user compresses foam 32 by pressing on cover 26 above foam 32. This pressing of foam 32 will force the ink or dye out of the foam and into second reservoir 33. As this occurs, the ink or dye will fill (or partially fill) second reservoir 33 while pooling or sitting on the surface of base 22 because it is non-porous. Since the ink or dye is designed to have an observable color this compressing of foam 32 will result in a loss of some color from foam 32 and the simultaneous coloring of second reservoir 33 (especially when compared to the normal color of base 22). As an example of how this might appear, if base 22 is white and the ink or dye is red then the change in color of second reservoir 33 will be dramatic as it goes from white to red. In some embodiments it may be desirable that second reservoir 33 is not completely open but instead contains a porous material which allows the ink or dye to be squeezed out of foam 32 but then allows foam 32 to preferentially reabsorb the ink or dye over a period of time.

When foam 32 is compressed by the user, some or most of the ink or dye will flow out of foam 32 into second reservoir 33 and onto base 22. The dye in second reservoir 33 and onto base 22 make it is obvious to an observer that at some point in the past foam 32 has been compressed. However, if the ink or dye simply remained in perpetuity in second reservoir 33 then a user would only know that at least once in the past monitoring apparatus 13 had been activated. This knowledge of one time use would not be very helpful for multiple use apparatuses. Fortunately, foams or any other absorbing materials, by their very nature, will tend to absorb liquids in contact with them. Accordingly, immediately after foam 32 is compressed and releases its ink and dye, foam 32 will begin the process of reabsorbing the same ink or dye. After a predetermined range of time after having pressure applied to the foam 32, the ink or dye that was originally in foam 32 and then forced out into second reservoir 33 will be mostly reabsorbed into foam 32. In one embodiment, the predetermined range of time is based upon a pharmaceutical attribute, such as length of time between use of a pharmaceutical container, an expiration date for medication contained in the pharmaceutical container, and the like. At this point an observer will be able to see the original color of the surface of base 22 (some portions of base 22 may remain covered with ink or dye but significant portions will be ink or dye free). By looking at the indicator and quickly noting if base 22 is covered with ink or dye, the user will be able to monitor the re-absorption of the ink or dye.

In an alternative embodiment, it may be possible to leave out base 22 and simply make cover 26 entirely surround second reservoir 33 and foam 32. In a case without base 22 the user would peer into transparent cover 26 to look for the presence or absence of the ink, dye or other fluid in second reservoir 33. In this embodiment the lower portion of cover 26 might be coated to make it a color which contrasts dramatically with the color of the ink or dye. In such an embodiment the top portion of cover 26 would necessarily remain transparent so that the user can observe the color changes.

This re-absorption process will take place over roughly the same period of time each time monitoring apparatus 13 is activated. By knowing how long the re-absorption process takes, and observing whether ink or dye remains in second reservoir 33, the user will know the minimum amount of time that has passed since they last activated monitoring apparatus 13 by pushing down on foam 32 (through cover 26). Since this likely corresponds with the last time they took their medicine, this allows them a quick visual check to see if they have used pharmaceutical container 11 over some period of time of interest to them.

By choosing different viscosities of observable fluid (e.g., ink or dye) and different characteristics of foam (e.g. different densities or cell sizes) it is possible to come up with a number of different time periods for re-absorption of the ink or dye. This allows for the design and manufacture of a number of different indicators designed to accomplish re-absorption of the observable fluid (e.g., ink or dye) over differing time periods depending on the medicine of interest. For example, for a statin which is intended to be taken only once a day, the desired re-absorption period is likely over eight to twelve hours and perhaps even more preferably sixteen to twenty-four hours. This would allow a user who has forgotten whether or not he has taken the pill to view the indicator to see if second reservoir 33 is largely clear of ink or dye. If it is largely ink or dye clear then they know that they have not activated the indicator for some long period of time and it is likely that they have not taken the pill that day. Similarly if they recently took the pill but forgot that they had taken it they could check the indicator and if second reservoir 33 has lots of ink or dye in it (i.e. the surface of base 22 is completely covered) then they will know that they've already taken the pill that day and they won't over medicate themselves by unnecessarily taking a second pill.

In another embodiment, not expressly shown, the ink or dye squeezed out of the foam may enter tubes rather than an open space as shown in FIGS. 1 and 2. The process of re-absorption would work similarly.

As a second example, for a pill intended to be taken every four hours (e.g. a pain reliever such as ibuprofin), by choosing less viscous dyes or less dense foams the indicator can be designed to reabsorb the ink or dye in a three to four hour period. Like with the statin above, this ability to know from viewing the indicator whether or not it has been activated during a minimum period of time is extremely helpful to a user. It can act as a reminder that the pill has not been taking during the period of time desired (i.e. the observable fluid is not in second reservoir 33) or that the pill has been taken in less than the minimum period of time between doses (i.e. the observable fluid has not been totally reabsorbed).

As an alternative to having different indicators for different desired times, it may be possible to have a single indicator. The single indicator might be of long duration and include with the indicator a strip showing different shades of color which correspond to different re-absorption durations. These kinds of strips have been used in the pool chemistry industry to allow users to gauge amounts of chemicals in their pool (e.g. chlorine levels). The same concept of matching colors with duration since use of the indicator may be possible in the subject invention. The differing shades of color foam 32 may be the standard for a user to view in this case as opposed to looking the coloring of second reservoir 33.

FIG. 2 shows a top view of cap 12 and monitoring apparatus 13 from FIG. 1. The purpose of FIG. 2 is to show that it might be desirable for foam 32 to have appendages 35. Appendages 35 (e.g. fingers, tenticles or peninsulas) are designed to reach out into second reservoir 33 in order to make sure that all or most of the ink or dye is able to be reabsorbed by foam 32. Appendages 35 of foam 32 may be especially desirable if monitoring apparatus 13 is not attached to a flat surface on pharmaceutical container 11 or cap 12 or if the user stores their medical containers on their sides or tilted off the horizontal plane. In these cases the ink or dye which is pushed out into second reservoir 33 may need to fight gravity in order to be reabsorbed into the foam 32. Appendages 35 will help accomplish this anti-gravity feat.

FIG. 3 shows one embodiment which does not necessarily include an absorbent material to hold the fluid. In FIG. 3, monitoring apparatus comprises observable fluid 120 (which may be a dye, ink, viscous gel or any other flowable or spreadable medium) contained between flexible membrane 110 and base 102. Membrane 110 and base 102 are normally sealed around their periphery. Base 102 may include an attachments means 101 to allow monitoring apparatus 100 to be attached to various articles such as the pill bottle of FIGS. 1-2. It may also be incorporated as an integral part of any of the various apparatuses or containers with which it may be associated. In one embodiment, the first reservoir and second reservoir are indistinguishable until monitor 100 is pressured. At this time, the observable fluid flows away from the pressured area (e.g., first reservoir), and into the portion of monitor 100 not being pressured (e.g., second reservoir).

FIG. 4 shows monitoring apparatus of FIG. 3 as it is being pushed by finger 200. As shown in FIG. 4, as finger 200 presses down on membrane 110, membrane 110 depresses and pushes fluid 120 away from a first area (i.e., first reservoir) to a second area (i.e., a second reservoir or an area of less pressure). This push or pressure may be associated with an event such as the opening of a pill bottle or pharmaceutical container, or any other related event. The pressure on monitoring apparatus may also not be associated by any particular event but may be done consciously by a user wishing to know a time duration for an act unassociated with any particular apparatus. In this embodiment, monitoring apparatus may simply be placed anywhere on any surface and the timer/indicator is activated by a user remembering to activate the timer (as opposed to activation being automatic as some event occurs or upon activation of an apparatus or container). For one example, the monitoring apparatus may be placed on a dog bowl and pressed each time the animal is fed in order to allow a pet owner to monitor whether the pet was recently fed.

FIG. 5 shows monitoring apparatus 100 of FIGS. 3 and 4, a period of time after finger 200 has pressed monitoring apparatus. In order for finger 200 to be able to compress membrane 110, it is important that there be sufficient space for fluid 120 to migrate to when pressure is exerted (i.e. you can not overfill the space between first reservoir 102 and membrane 110 with fluid 120). FIG. 5 shows membrane 110 still in the compressed state and with fluid 120 still pushed away from area 150 (i.e., pressured area) where the indentation remains. In at least one embodiment, there is a color difference between base 102 and fluid 120 and membrane 110 is transparent. In this instance the user will dramatically see the pressured area 150 where finger 200 has pressed down since base 102 is visible in this area surrounded by the contrasting color of fluid 120 in the remainder of monitor 100. In some embodiments it may be base 102 which is transparent and the color of flexible membrane 110 is different from fluid 120 in order to see the contrast (in some embodiments both membrane 110 and first reservoir 102 may be transparent).

In one embodiment, base 102 is less soft or pliable than membrane 110. This is so that when one presses on membrane 110, fluid 120 is forced out of the way because of the relative rigidity of base 102. Base 102 can be made of any of a large number of various materials well known in the art such as a rigid plastic (e.g. acrylics, pvc, thick polystyrene), wood, rubber, metal sheets (e.g. aluminum foil), canvas or heavy paper products such as cardboard.

Membrane 110 can also be comprised of a large number of various materials. It is important that it be less stiff than base 102; durable enough not rupture under normal pressure; and it should be able to return roughly to its original shape after pressure is exerted upon it (e.g. have a memory). Also like base 102 it should be compatible with fluid 120 and nonporous to fluid 120.

After pressure is exerted on membrane 110 it should start to return (more or less) to its original shape and fluid 120 will flow back into the space it has been squeezed away from. This returning of membrane 110 roughly to its original shape can be caused by (1) the flow of fluid 120 back into the space it was squeezed out of by the pressure; (2) membrane 110 has a "memory" and it is predisposed to return to its original shape; or (3) a combination of (1) and (2) immediately above.

As fluid 120 returns to area 150 (i.e., the area underneath of where the pressure was exerted upon membrane 110), a color change will occur (i.e. either one begins to see the color of fluid 120 in the area or the color of base 102 will slowly disappear or some combination of the two. By carefully choosing the viscosity and characteristics of fluid 120 and the thickness, pliability, memory, tautness of membrane 110 (i.e. now tightly it is stretched across monitoring apparatus) and other membrane characteristics, one can control how long it takes for fluid 120 to return to its original position and recover the portion of base 102 that it was squeezed away from.

In another embodiment of the indicator of FIG. 3 (not expressly shown), there could be an absorbent material (similar to FIGS. 1-2) included in the area between membrane 110 and base 102 where pressure is exerted. It may also be desirable to have some type of button, piston or other device (not expressly shown) that presses upon membrane 110 rather than a finger or other body part, in order to assure that the pressure is consistently applied and that the area where fluid 120 is pressured away from is consistently the same size.

Membrane 110 can be made of numerous different substances. A few non-exhaustive examples include thermoplastic resins such as polyethylene, polyvinylchloride or copolymers of vinyl chloride and vinyl acetate. Other thermoplastic resins include polyvinyl acetate, polymethyl methacrylate, cellulose acetate butyrate, polyvinylidene chloride, polyvinyl butyral, polysulfone, and copolymers and/or combinations thereof. Any membrane (or sheet) will work so long as it is pliable enough, tough enough to resist tearing, compatible chemically with fluid 120 and will return repeatedly to roughly its original shape after pressure is exerted upon it (this return may be caused by either the memory of the material or the pressure from fluid 120 or a combination of the two).

The thickness of membrane 110 may be of any suitable thickness and may change dramatically depending upon the final intended use (e.g. the thickness for a vitamin bottle might differ from a dog bowl). U.S. Pat. No. 5,958,525 (incorporated herein by reference) sets forth thicknesses for the finger painting product with a range of from about 0.1 mil (0.0001 inch) to about 10 mil (0.01 inch).

An example of an apparatus where a fluid is compressed between a base and a membrane can be seen in an unrelated end use with a commercial product. Crayola (owned by Binney & Smith) has a product called Creativity Central having as a component a board for "Mess Free Finger Painting". The Crayola product allows kids to finger paint through a membrane in order not to create a mess. During an experiment with this commercial product, a user pressed their forefinger into the membrane until the background color was showing. This indentation was 1.1 centimeters in diameter. Two hours later, the indentation area (i.e. the area not covered by the blue fluid) was 0.5 cm in diameter. Six hours later the entire original indentation was covered by the blue fluid. Further, by changing the portion of the screen of the "Mess Free Finger Painting" product where a person presses with their finger, one can change the time required for an indentation to be refilled by blue fluid. In some areas of the screen the blue fluid will not refill the indentation. In others it can happen very quickly. By picking the right amount of blue fluid in an area (which relates to tautness of the cover) an experimenter can change the time required for the blue fluid to cover the indentation.

Figure 6:
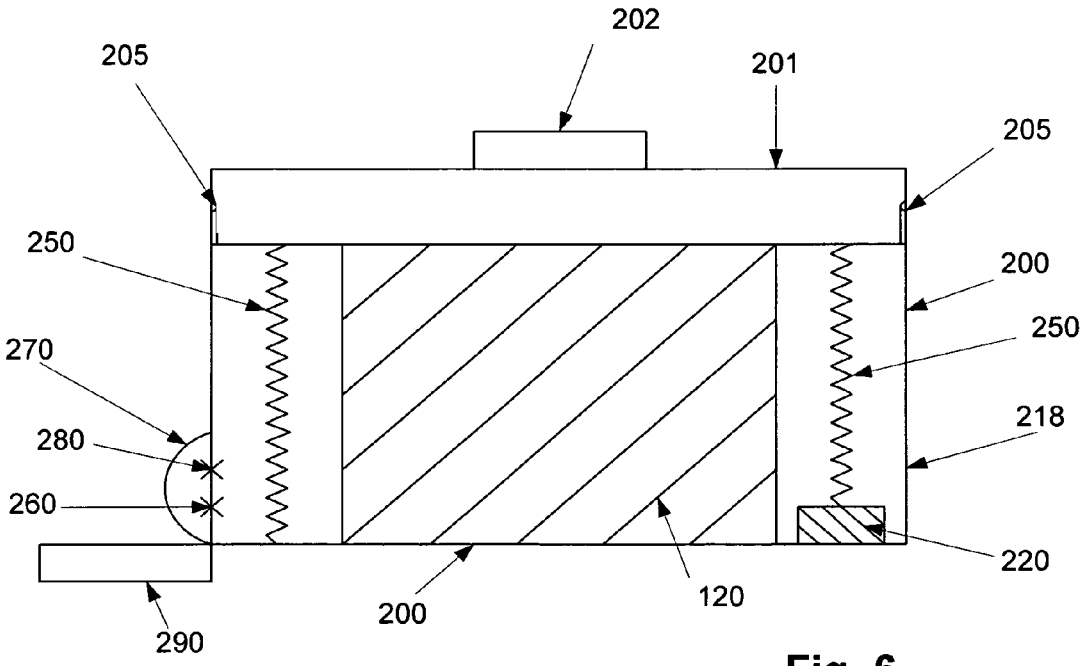
FIG. 6 is a side view of an alternate embodiment of a monitoring apparatus having a deformable absorbent material, a check valve, an elastomeric reservoir and a second valve allowing slow return of the fluid to the absorbent material.
Figure 7:
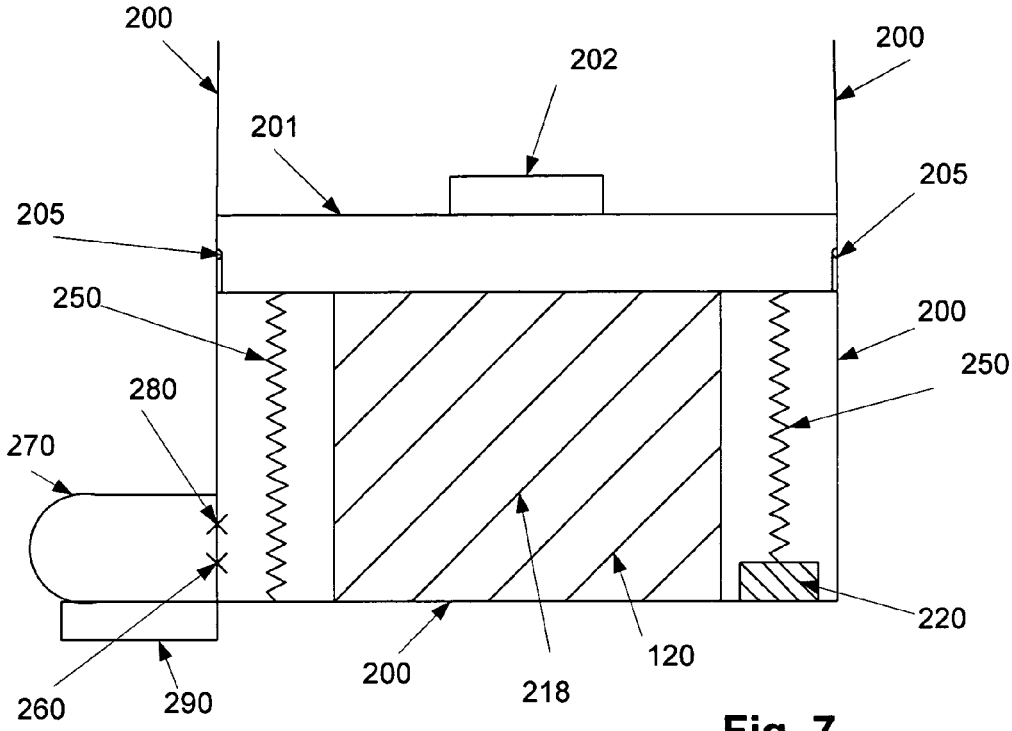
FIG. 7 is a side view of the alternate embodiment of the monitoring apparatus shown in FIG. 6 after pressure has been applied and the fluid has entered the elastomeric reservoir, and before the fluid has returned through the slow return valve to the absorbent material.

Another embodiment of the invention is shown in FIGS. 6-7. In this embodiment of the invention, fluid 120 is contained within absorbent material 218. Absorbent material 218 is housed within a first area of the indicator defined by a non-porous container 200. Container 200 is adapted to accept piston 210 when button or activator 202 is pressed. As piston 201 enters container 200 it compresses absorbent material 218 which in turn squeezes out fluid 120 (there may be fluid both inside of absorbent material 218 and also within other areas of container 200 not filled with absorbent material 218). To assure that piston 201 enters container 200 far enough to squeeze out the desired amount of fluid 120 there is pressure indicator 220. Mechanical devices which "click" or give some other tactile or audible indication when a member is fully engaged are well known in the prior art. Piston 201 of this embodiment is associated with springs 250 which serve to return piston 201 to its normal position after the piston has been fully inserted into container 200. This return of piston 201 allows absorbent material 218 to return to its normal size and shape after it has been compressed by piston 201.

As piston 201 compresses absorbent material 218 and reduces the volume available in container 200 for fluid 120 (fluid 120 can not escape around piston 201 because of O-ring 205) it is forced through check valve 260. Check value 260 is a one way valve like many well known in the prior art (e.g.

umbrella check valves and so forth). It allows the flow of fluid 120 only in the direction out of container 200 and into a second area of the indicator defined by an elastomeric membrane 270. As fluid 120 flows into the balloon like container defined by elastomeric membrane 270, membrane 270 expands to accept fluid 120.

The expanded version of elastomeric membrane 270 is shown in FIG. 7. FIG. 7 also shows piston 201 before springs 250 have returned the piston to its normal, non-pressured position as shown in FIG. 6. As membrane 270 is expanded as shown in FIG. 7 it builds up a certain amount of energy (i.e. internal stresses) and membrane 270 desires to return to its non-stressed state. However, this can only happen if fluid 120 is released from membrane 270. This cannot occur through one way check valve 260 but it can occur through slow release valve 280. Slow release valve 280 can be as simple as a very small orifice (e.g. like a leak) which only allows small amounts of fluid 120 at a time to flow through back into container 200 and absorbent material 218. Since absorbent material 218 is now back into its normal shape and size it will readily absorb fluid 120 as it returns to container 200. Or it can also be any of a number of pressure relieving or slow release valves well known in the art. One example is shown in U.S. Pat. No. 6,236,624 (which is incorporated herein by reference). The '624 patent discloses a small opening filled with a porous material (e.g. a porous flit) through which fluid 120 can flow.

In another embodiment of the apparatus as shown in FIGS. 6-7 (not expressly shown) it may not be necessary to have an absorbent material within the container to be compressed by the piston. The absorbent material of FIGS. 6-7 can help the return of the fluid from the container with the elastomeric material which is stressed because the absorbent material has a natural tendency to suck up or absorb the fluid. However the internal stresses of the stressed elastomeric material may be sufficient alone to transfer all the fluid back into the original area of the indicator.

Unlike in the '624 patent which uses mechanical movements caused by the fluid flows to effect some pneumatic result (i.e. the triggering of an electrical contact) because of the movements of the two parts relative to each other, the current invention indicates the passage of time by a user visually observing the flow of fluid into and out of elastomeric membrane 270. This could be indicated by a color change of area 290 adjacent to membrane 270. For example, if area 290 is white but membrane 270 is red, a user when looking from above the indicator will note that area 290 is white before the indicator is activated (i.e. the fluid has not inflated membrane 270 and the user is viewing the white surface of area 290). However, after the indicator has been activated, membrane 270 inflates and covers white area 290. The same viewer will now see area 290 as being red (or any other color in contrast to the color of area 290). The color change can be caused either by membrane 290 being colored or membrane 290 being transparent and fluid 120 being colored. The choices of colors are not crucial but it is preferable that there be some contrast between the color of area 290 and membrane 290 or fluid 120. In another embodiment, membrane 270 may normally be hidden from view and the indication of use occurs when it expands such that a user now sees membrane 270 as it expands.

As disclosed in the '624 patent, the elastomeric material which is pressured by the fluid flow and subjected to internal pressures does not necessarily comprise a balloon like container of FIGS. 6-7. The elastomeric material may be disposed within a rigid container and the elastomeric material becomes compressed inside of this rigid container. In this embodiment (not expressly shown) the reversal of these internal stresses on the compressed material is what causes the fluid to reverse its flow through the valve leading back into the original container. There are a number of different ways for a fluid to flow quickly under pressure in one direction and then reverse its flow in another direction more slowly. Any of these modifications are intended to be covered by the claims of the subject patent.

In another embodiment, the color change is accomplished using electricity and different color lights on the indicator of the monitoring apparatus. For example, a green illuminated light on top of a pill bottle or other apparatus may mean that it is acceptable to take another pill or use the apparatus. On the other hand, a red illuminated light might mean that the pill bottle has recently been opened or activated, and the user should delay taking another pill or using the apparatus until the red light goes out and the green light becomes illuminated again. This simple, color-coded system is intuitive and very easy to understand. Most users know that red means "stop" and green signifies that it is alright to "go". It is understood that other colors may be used and it is possible that one can forego with either the red light or the green light. In an alternate embodiment using only one light, a red light could be used to indicate a user should not take another pill or use the apparatus. Similarly, the one light could be a green light indicating when it is alright for a user to take a pill or use the apparatus. In this embodiment having only one light, a test button may be included for a user to test a battery so that the user can know whether the lack of an illuminated light is due to a dead battery.

Figure 8:
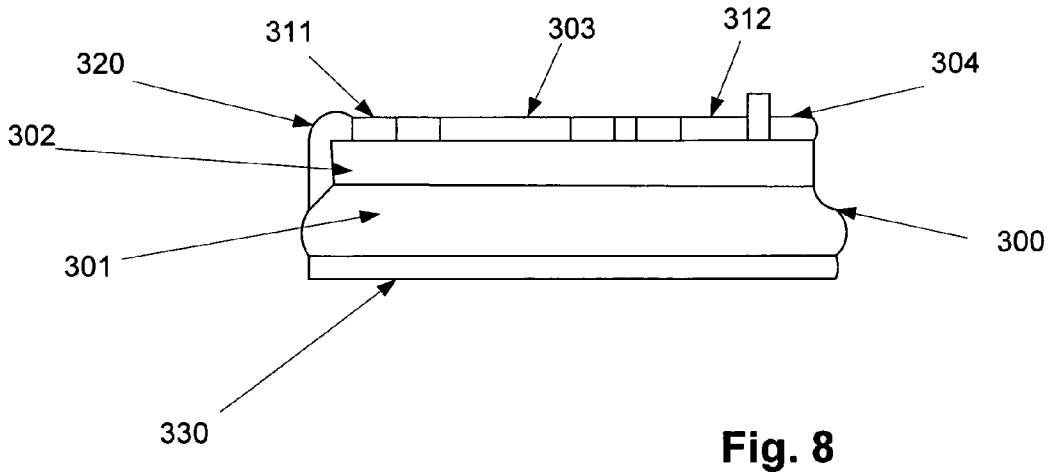
FIG. 8 is a side view of an alternate embodiment of a monitoring apparatus having electrical means for changing color lights on the monitoring apparatus.

In FIG. 8, monitoring apparatus 300 comprises battery 301 connected to printed circuit board 302, and a cover 320 over the monitoring apparatus 300. Board 302 comprises controller 303, red light 311, green light 312, and switch 304. Controller 303 controls the illumination timing of red light 311 and green light 312. The controller timing is activated by button 304, which is triggered when a user opens the pharmaceutical container, or uses some apparatus, and indicates that a pill has been taken or the apparatus used. When switch 304 is triggered, controller 303 causes red light 311 to illuminate for a period of time associated with a predetermined range of time, such as the minimum period of time necessary between dosages of the medicine. At the end of the predetermined range of time, controller 303 turns off red light 311 and begins illuminating green light 312. This signifies to the user that the pharmaceutical bottle or other apparatus is safe to use again.

Some medications have both a minimum period of time between uses and a maximum number of times per day the medication can be taken over and beyond the minimum period of time. Controller 303 can be programmed so that red light 311 stays on even after the minimum period of time has passed if the pill bottle has already been opened the maximum number of times allowable for the day. For example, if a pain medication is designed to be taken every four hours but can only be taken three times over a twenty-four hour period, the red light will stay illuminated after the third dosage within the twenty-four hour period, even after the four hour minimum period has passed after the third dosage.

Controller 303 may be permanently set to one specific minimum period of time, i.e. the time in which red light 311 is illuminated. This non-programmable use of monitoring apparatus 300 may be used when the monitoring apparatus 300 is only used with one type of medication or apparatus. In such a case, the monitoring apparatus 300 can become an integral part of the pharmaceutical bottle cap or bottle. In other cases, monitoring apparatus 300 may be used with multiple various medications or apparatuses. In one embodiment described herein, the monitoring apparatus 300 is likely to have releasable attachment means 330 so that the monitoring apparatus 300 can be taken on and off of different pharmaceutical containers or other apparatuses. When monitoring apparatus 300 is usable in different situations, it may be desirable for controller 303 to be programmed to different minimum times, such as four hours for a pain reducing medication, or eighteen to twenty-four hours for a statin. This programming of controller 303 can be accomplished by including small buttons or other activators (not expressly shown) on either board 302 or controller 303, which can be pushed and can change the timing of lights 311 and 312.

Further modifications and alternative embodiments of the techniques described herein will be apparent to those skilled in the art in view of this description. It will be recognized, therefore, that the techniques described herein are not limited by these example arrangements. Accordingly, this description is to be construed as illustrative only and is for the purpose of teaching those skilled in the art the manner of carrying out the techniques described herein. It is to be understood that the forms of the techniques described herein shown and described are to be taken as the presently preferred embodiments. Various changes may be made in the implementations and architectures. For example, equivalent elements may be substituted for those illustrated and described herein and certain features of the techniques described herein may be utilized independently of the use of other features, all as would be apparent to one skilled in the art after having the benefit of this description of the techniques described herein.

What is claimed is:

1. A monitoring apparatus for monitoring time by a color change indicator capable of being used multiple times, comprising: a colored fluid which causes an observable color change in a transparent section of the apparatus during operation of the apparatus; a first reservoir holding at least a portion of the colored fluid; and a second reservoir, defined by non-porous surfaces, abutting the first reservoir; wherein the first reservoir is responsive to pressure on it such that a portion of the colored fluid flows into the second reservoir; wherein the second reservoir is responsive to a lack of pressure in the first reservoir such that a portion of the colored fluid in the second reservoir reverses flow back into the first reservoir once the first reservoir is not under pressure.

2. The monitoring apparatus of claim 1, wherein reversing the flow of the colored fluid from the second reservoir to the first reservoir occurs over a predetermined range of time.

3. The monitoring apparatus of claim 2, wherein the first reservoir is defined by a rigid base and a compressible cover which when pressure is applied to said compressible cover, said pressure pushes at least a portion of the fluid from the first reservoir into the second reservoir.

4. The monitoring apparatus of claim 3, wherein the second reservoir is defined by the rigid base and the compressible cover of the first reservoir.

5. The monitoring apparatus of claim 4, wherein the compressible cover is a membrane having a memory configured to return to its original shape over a predetermined range of time after having pressure applied to the membrane.

6. The monitoring apparatus of claim 2, wherein the first reservoir contains an absorbent material holding at least a portion of the colored fluid.

7. The monitoring apparatus of claim 2, wherein the monitoring apparatus is connected to a pharmaceutical container, and the predetermined range of time is based upon a pharmaceutical attribute.

8. The monitoring apparatus of claim 7, wherein the monitoring apparatus is activated by the pressure exerted to bypass a child-protective lock.

9. The monitoring apparatus of claim 1, wherein flow of the fluid between the first reservoir and the second reservoir is controlled by an interface, comprising: a one-way valve allowing the fluid to flow out of the first reservoir into the second reservoir when under pressure in the first reservoir, wherein the one-way valve is configured to prevent reentry of fluid into the first reservoir from the second reservoir; an elastomeric material in the second reservoir; and a second valve configured to allow the fluid in the second reservoir to return to the first reservoir.

10. A method for monitoring time comprising the steps of: providing a monitoring apparatus capable of being used multiple times, the apparatus comprises: a colored fluid which causes an observable color change in a transparent section of the apparatus during operation of the apparatus; a first reservoir holding at least a portion of the colored fluid; wherein the first reservoir is responsive to pressure on it such that a portion of the colored fluid flows into the second reservoir; wherein the second reservoir is responsive to a lack of pressure in the first reservoir such that a portion of the colored fluid in the second reservoir reverses flow back into the first reservoir once the first reservoir is not under pressure; applying pressure to the first reservoir; forcing at least a portion of the colored fluid from the first reservoir into the second reservoir; and observing a color change through a transparent section in at least one of the reservoirs.

11. The method of claim 10, wherein reversing the flow of the colored fluid from the second reservoir to the first reservoir occurs over a predetermined range of time.

12. The method of claim 11, wherein the first reservoir is defined by a rigid base and a compressible cover which when pressure is applied to said compressible cover, said pressure pushes at least a portion of the fluid into the second reservoir; and the second reservoir is defined by the rigid base and the compressible cover of the first reservoir.

13. The method of claim 12, wherein the compressible cover is a membrane having a memory configured to return to its original shape over a predetermined range of time after having pressure applied to the membrane.

14. The method of claim 11, wherein the first reservoir contains an absorbent material holding at least a portion of the colored fluid.

15. The method of claim 11, wherein the monitoring apparatus is connected to a pharmaceutical container, and the predetermined range of time is based upon a pharmaceutical attribute.

16. The method of claim 10, wherein flow of the fluid between the first reservoir and the second reservoir is controlled by an interface, comprising: a one-way valve allowing the fluid to flow out of the first reservoir into the second reservoir when under pressure in the first reservoir, wherein the one-way valve is configured to prevent reentry of fluid into the first reservoir from the second reservoir; an elastomeric material in the second reservoir; and a second valve configured to allow the fluid in the second reservoir to return to the first reservoir.

* * * * *

UNITED STATES PATENT AND TRADEMARK OFFICE

CERTIFICATE OF CORRECTION

PATENT NO. : 7,963,692 B2
APPLICATION NO. : 12/380331
DATED : June 21, 2011
INVENTOR(S) : John M. Lynn It is certified that error appears in the above-identified patent and that said Letters Patent is hereby corrected as shown below:

In the Cross Reference to Related Application Section on page 1, Provisional Patent Application No. 61/129,676 is incorrect and should read 61/124,676 instead.

Signed and Sealed this
Thirtieth Day of August, 2011

David J. Kappos

David J. Kappos
*Director of the United States Patent and Trademark Office*